United States Patent [19]

Gillbrand et al.

[11] Patent Number: 4,848,287

[45] Date of Patent: Jul. 18, 1989

[54] METHOD AND SYSTEM FOR CONTROLLING SPARK IGNITION IN INTERNAL COMBUSTION ENGINE

[75] Inventors: Per S. Gillbrand, Mariefred; Sven H. Johansson; Jan G. Nytomt, both of Amal, all of Sweden

[73] Assignee: Saab-Scania Akt., Sweden

[21] Appl. No.: 148,652

[22] PCT Filed: Jun. 9, 1986

[86] PCT No.: PCT/SE86/00276

§ 371 Date: Jan. 26, 1988

§ 102(e) Date: Jan. 26, 1988

[51] Int. Cl.[4] ..... F02P 15/04

[52] U.S. Cl. ..... 123/162; 123/406; 123/596

[58] Field of Search ..... 123/156, 162, 406, 625, 123/596, 169 EA

[56] References Cited

U.S. PATENT DOCUMENTS 2,298,219 10/1942 Major ..... 123/162
3,349,760 10/1967 Horan ..... 123/162
3,444,850 5/1969 Horan ..... 123/169 EA
3,900,017 8/1975 Collins ..... 123/628
4,774,914 10/1988 Ward ..... 123/162

*Primary Examiner*—Andrew M. Dolinar
*Attorney, Agent, or Firm*—Ostrolenk, Faber, Gerb & Soffen

[57] ABSTRACT

Disclosed is a method for controlling the spark ignition in an Otto engine, of the type including an ignition voltage-generating ignition system with a spark plug electrode fixedly arranged in the combustion chamber of the engine and with an earth electrode co-operating movably therewith and joined fixedly to the engine piston in question. For the purpose of producing a controlled ignition moment in such engines the ignition moment is controlled so as to occur later and with shorter sparking distance when the engine load increases from light load to whole load. At the same time, the ignition voltage necessary for spark formation is controlled so as to vary within relatively narrow limits over essentially the whole load range.

14 Claims, 2 Drawing Sheets

METHOD AND SYSTEM FOR CONTROLLING SPARK IGNITION IN INTERNAL COMBUSTION ENGINE

BACKGROUND AND SUMMARY OF THE INVENTION

The present invention relates to a method and system for controlling spark ignition of a fuel/air mixture contained in the combustion chamber of an Otto engine, of the type including an ignition voltage-generating ignition system comprising at least one spark plug electrode for spark ignition fixedly arranged in each combustion chamber and with an earth electrode co-operating movably therewith and joined fixedly to the engine piston in question.

Two-part ignition arrangements of the type mentioned above are known in a large number of embodiments, and disclosed for example, by U.S. Pat. Nos. 1,623,432 and 2,253,204. In the known solutions, as a result of the division of the ignition arrangement into two parts, simple ignition systems are used for generating the ignition voltage to the ignition arrangement in question. However, the moment of the ignition spark formation occurs in an uncontrolled manner by virtue of the fact that ignition takes place when the electrodes are sufficiently close to one another to cause spark formation under the prevailing pressure and temperature conditions. Solutions of this type may be adequate for engine applications where demands on fuel consumption, exhaust gas emissions and performance are comparatively small and/or where the engine runs with small variations in the operating conditions. However, the demands placed on modern engines for operating passenger cars cannot be satisfied by solutions of this type.

An object of the present invention is to make a method and system, when using two-part ignition arrangements on modern Otto engines for motor vehicle operation, for controlling the ignition such that a well-controlled combustion is achieved under widely differing operating conditions. In this connection the invention involves the ignition moment being controlled in relation to the sparking distance such that an ignition spark necessary for satisfactory combustion of the fuel-/air mixture is obtained independently of whether the engine is running at low or high load. For this purpose the invention is characterized in that, for each engine speed, ignition voltage is generated for spark formation at a first ignition moment, which at a first engine load value corresponds to a first sparking distance, while at a second engine load value, which is higher than the first, ignition voltage is generated at a second ignition moment which corresponds to a second sparking distance shorter than the first. Further, the ignition moment is controlled over essentially the whole load range for the engine in such a way that the ignition voltage level for spark formation, which in a manner known per se depends on the engine load and the sparking distance, varies within relatively narrow limits.

The invention makes possible an advantageous application of two-part ignition arrangements in modern Otto engines which run under considerably varying loads and with high demands placed on performance, fuel consumption and exhaust gas emissions, such as is the case in operation of cars. For the foregoing type of engines, the solution according to the invention ensures, at each engine speed, spark formation over a predetermined long sparking distance when the engine is running at a low load and over a successively shorter sparking distance as the load increases. The ignition voltage and with it the spark energy can thus be maintained at a high level over the whole load range, which ensures satisfactory ignition and combustion of the fuel/air mixture within the whole range mentioned. The risk of incomplete combustion with, as a consequence, increased exhaust gas emissions and impaired exhaust gas catalyst function is thus reduced, and at the same time the engine runs economically in terms of fuel and achieves smooth running which is desirable from the point of view of comfort.

In an advantageous embodiment of the invention the ignition moment is controlled such that the ignition voltage essentially varies by less than 20 percent about a mean value defined by the limits. This means in practice that the above-mentioned ignition voltage level, and the spark energy which is essentially in proportion thereto in every respect, is considerably raised particularly at low engine load compared with the levels which occur in known engines, the ignition arrangements of which have a fixed sparking distance. In this way the risks of unsatisfactory ignition of the fuel/air mixture at low engine load can be considerably reduced.

BRIEF DESCRIPTION OF THE DRAWINGS

Other features characterizing the invention will become apparent from the attached patent claims and the following description of an exemplary embodiment of the invention. In the description reference is made to the figures in which

DESCRIPTION OF THE PREFERRED EMBODIMENT

Figure 1:
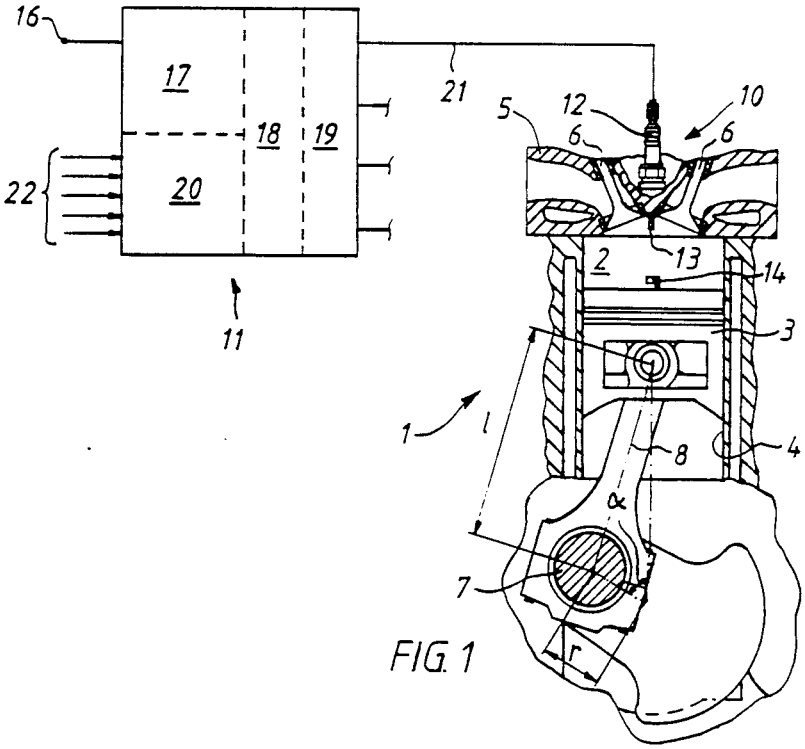
FIG. 1 shows schematically an internal combustion engine with an ignition system comprising a two-part ignition arrangement to which the method according to the invention can be applied.

FIG. 1 shows schematically a combustion chamber 2 in a multicylinder Otto engine 1. In conventional manner the combustion chamber 2 is delimited by a piston 3, a cylinder 4 and a cylinder head 5 wih valves 6 included in it for controlling the entry and outlet of the fuel/air mixture relative to the combustion chamber. In the manner known for the 4-stroke principle, the control of the valves 6 is effected in dependence on the forward or up and backward or down movement of the piston 3 as viewed in FIG. 1. This is determined by the crankshaft 7 of the engine and by a connecting rod 8 connected to the piston and the crackshaft.

The ignition of the fuel/air mixture (hereinafter referred to as the gas mixture) effected during the compression stroke is achieved by means of a two-part ignition arrangement 10, which is included in an ignition-control ignition system 11. The ignition arrangement comprises a spark plug 12 attached to the cylinder head 5 with a center electrode 13 for supplying ignition voltage and with an earth electrode 14 arranged on the piston 3 and following the movement of the latter.

The ignition is controlled by the ignition system 11 which, in the present invention, is advantageously of the capacitive type. In this connection the ignition system 11 includes in known manner a low-voltage source 16, a charging circuit 17, a discharging circuit 18, an ignition circuit 19 and an ignition pulse trigger unit 20. The low-voltage source 16 is expediently of the 12V battery type and the charging circuit 17 transforms this low voltage up to about 400V for charging a charging capacitor (not shown). After release of the trigger unit 20, the discharging circuit 18 provides for the discharging of the charging capacitor via the primary winding in one of several ignition coils (not shown) to each one of which is assigned an ignition arrangement of an engine cylinder. In the ignition circuit 19 an ignition voltage is then generated in the secondary winding of the ignition coil, which voltage is supplied to the spark plug electrode 13 in question via a wire 21. The ignition pulse trigger unit 20 controls, by means of a microprocessor incorporated therein, the ignition moment, i.e. the moment of discharging of the charging capacitor, for supplying ignition voltage to the respective ignition arrangement. This is effected on the basis of incoming data on a wire bundle 22 in respect of engine speed, engine load, engine temperature and, possibly, further signals in respect of, for example, exhaust gas emissions, fuel/air ratio, engine knocking etc.

The use of microprocessor technology for determining the ignition moment on the basis of incoming data such as mentioned above is well known in internal combustion engine technology and does not constitute part of the present invention. Thus, the present invention is not confined to any particular processor solution for controlling the ignition moment, but can be used together with any solution of this type available on the market.

Figure 2:
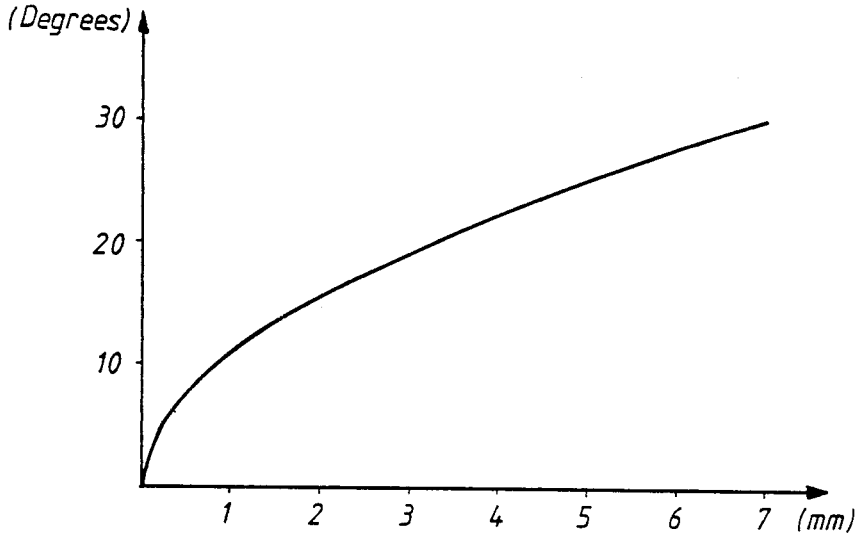
FIG. 2 shows the relationship of the sparking distance to the crankshaft angle.

In the present invention the ignition moment is controlled such that, for each speed, the ignition occurs at a different sparking distance depending on whether the engine is running at low or high load. In this context the expression low engine load does not include idling load, since, when idling, special demands regarding emissions and the like affect the choice of ignition moment and thus, on application of the present invention, also the sparking distance. FIG. 2 shows a curve of how the sparking distance varies depending on the value of the crankshaft angle at the top dead center (TDC) of the piston. The sparking distance S depends on the following equation:

$$S = r\left(1 + \frac{1}{r} - \cos\alpha - \sqrt{\left(\frac{1}{r}\right)^2 - \sin^2\alpha}\right)$$

where r is the crankshaft radius, l is the connecting rod length and $\alpha$ is the crankshaft angle. The parameters mentioned are defined in FIG. 1.

For an engine with $r \approx 40$ mm and a ratio $l/r \approx 3.4$ the following approximate sparking distances are obtained within the crankshaft angle range generally used in modern Otto engines at different engine loads for ignition of the gas mixture before the piston has reached the TDC.

| Crankshaft Angle | Sparking Distance |
|---|---|
| 30° before TDC | 6.8 mm |
| 25° | 4.8 |
| 20° | 3.2 |
| 15° | 1.8 |
| 10° | 0.8 |
| 5° | 0.2 |
| 0° | 0 |

The table values show that the sparking distance is 0 mm at the piston TDC, something which can of course be simply avoided by designing the electrodes such that they overlap one another by a certain distance in a crankshaft angle range of, for example ±5° of the piston TDC. Overlapping of this type also reduces the sparking distance at upper crankshaft angle values which can thus be adjusted to values suitable for spark formation without the ratio l/r having to be affected.

Figure 3A:
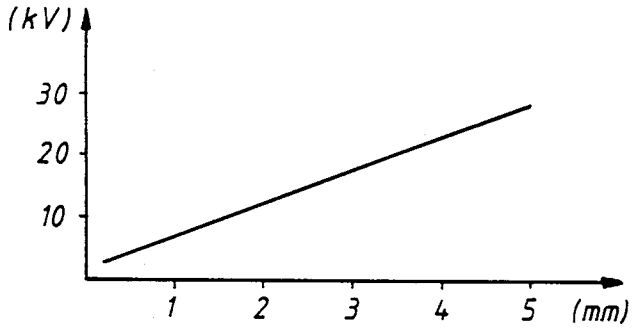
FIG. 3*a* shows the principal dependence of the ignition voltage on the sparking distance.
Figure 3B:
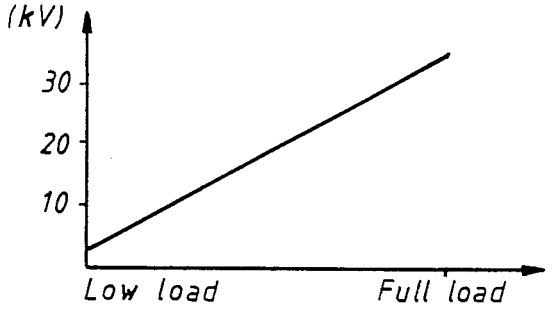
FIG. 3*b* shows the principal dependence of the ignition voltage on the engine load at a certain fixed sparking distance.

FIGS. 3*a* and 3*b* show how the ignition voltage depends on the sparking distance and the engine load. With otherwise unchanged conditions in respect of engine speed, engine load, fuel/air ratio etc. a higher ignition voltage is required for spark formation to take place the greater the distance between the electrodes. As emerges from FIG. 3*a*, the connection is essentially linear.

In a corresponding manner FIG. 3*b* shows how the ignition voltage requirement for reliable spark formation increases essentially linearly with increased engine load where there are otherwise unchanged conditions, including a fixed sparking distance. The increased engine load corresponds to a higher pressure in the combustion chamber during the compression stroke and the increased pressure makes spark formation difficult. In engines with a fixed sparking distance the latter must therefore be selected so short that the ignition voltage which is generated is able reliably to trigger spark formation. However, at the same time the operation of the engine at low load requires a sufficiently long sparking distance for the ignition voltage and with it the spark energy to be so high that the gas mixture which is relatively difficult to ignite at low load can reliably be ignited.

The problem of selecting a suitable fixed sparking distance is made worse if the engine is supercharged and thus runs over a considerably greater pressure range than a conventional aspirating engine. In the case of a supercharged engine, at the moment of ignition the compression pressure at full load can indeed amount to about 2,000 kPa whereas in an aspirating engine it usually reaches only about 1,500 kPa.

Figure 4:
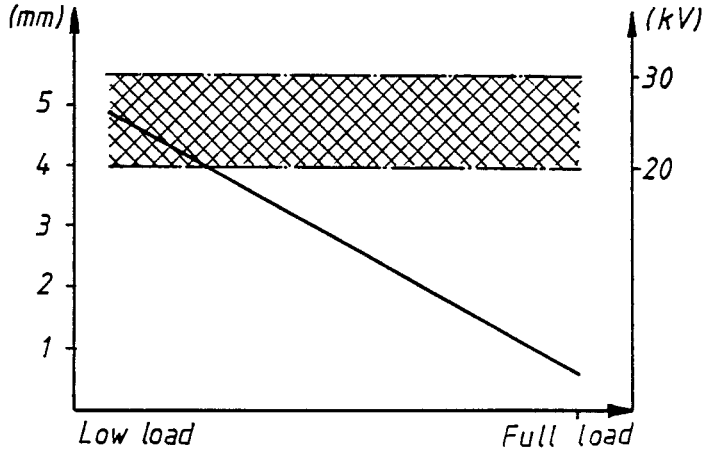
FIG. 4 shows the position of the ignition moment expressed as sparking distance depending on the engine load and also the ignition voltage requirement as this is obtained from its dependence on both load and sparking distance.

The method obtained according to the present invention for controlling the spark formation so as to occur at different sparking distances is therefore of particular advantage for a supercharged Otto engine. FIG. 4 shows a continuous line which shows how the ignition moment in the case of the present invention occurs at large sparking distances when the engine load is low, whereas it is controlled, with successively increasing engine load, so as to occur at successively shorter sparking distances. The change in distance with changed engine load can be affected, by selecting a suitable ratio between the crank-shaft radius r and the connecting rod length l, in such a way that the spark formation takes place at an ignition voltage which exhibits comparatively small variations over the whole load range of the engine. This is shown in FIG. 4 by the sectioned area between two horizontal broken lines. Independent of the engine load, the ignition voltage occurs in the range mentioned.

By comparatively small ignition voltage variations there are meant variations which are considerably less than is the case in a conventional Otto engine with fixed sparking distance. In such an engine the ignition voltage at low load can indeed be in the order of magnitude of 5 kV, whereas at high load it can amount to essentially over 20 kV. The differences relative to a mean value defined by the foregoing limits are by a good margin over 50 percent.

In an engine with a two-part ignition arrangement to which the method according to the invention is applied, the variation in ignition voltage can in contrast be maintained within ±20 percent from such a mean value. In this connection the engine should have an above-mentioned ratio l/r between 3.3. and 3.8. In the case of a supercharged Otto engine with the ratio l/r between 3.4 and 3.5 and equipped with a capacitive ignition system (CIS) with a two-part ignition arrangement, the ignition voltage has deviated by a maximum of 5 kV from a mean value of 25 V, i.e. varied between 20 and 30 kV. It thus follows that the sparking distance at a 25° crankshaft angle before the TDC is advantageously less than 5.5 mm in order to obtain the foregoing limited variation in ignition voltage. By measuring and establishing, on reference engines for the engine type in question, the ignition voltage requirement under different conditions, such as those represented by the incoming signals on the wire bundle 22 to the ignition pulse trigger unit 20, the ignition moment-controlling in unit 20 can then operate, on the individual engine samples, with programmed values of the sparking distance which results in an essentially constant ignition voltage in all operating conditions.

An important advantage is the distinctly increased ignition voltage and with it the spark energy which, in the method according to the invention, is available for igniting the gas mixture at low engine load. This makes possible reliable ignition and smooth running also under those operating conditions of the engine. In contrast to engines with fixed sparking distance, an engine to which the invention is applied can thus exhibit essentially the same ignition voltage at full and at low engine load, for which reason essentially the same demands are placed on the ignition system independent of the operating condition of the engine.

The variable sparking distance in a two-part ignition arrangement, which the present invention uses, is particularly advantageous in motor vehicle engines equipped with capacitive ignition systems, since, in these systems, the spark time is extremely short, which aggravates the problem of ignition of the gas mixture at fixed short sparking distances and low engine load. In this condition it is difficult for a sufficient amount of the gas volume located in the combustion chamber to come into contact with the spark. In inductive ignition systems this is solved by the burning time of the spark being extended to values which it is difficult to obtain with CISS. However, by varying the sparking distance, as is the case in the present invention the spark can acquire a greater length at low loads where the ignition problem is greatest. By this means a larger amount of the gas mixture comes into contact with the spark, which results in a more reliable ignition of such mixture. Contributing to this also is the fact that the division of the ignition arrangement into two parts results in a positioning and design of the spark plug electrode and earth electrode which means that the spark formation can occur centrally in the combustion chamber, which further facilitates the contacting of the gas mixture with the spark.

With the second method and system according to the invention there is also the advantage that the spark plug in the two-part ignition arrangement comprises only one center electrode. In order to insulate the center electrode an insulator is required, and the possibilities of provide such insulator to effectively and durably insulate the end extending into the combustion chamber increase considerably when the spark plug does not comprise an earth electrode. The high ignition voltages—in certain cases up to 40 kV—in a CIS can thus be reliably transmitted through such type of spark plug.

The invention can be modified in a number of ways within the scope of the subsequent claims, for example by controlling the ignition moment such that the ignition voltage varies within the above mentioned relatively narrow limits over an engine load range which does not include idling load and/or other special load cases such as, for example, the range around full engine load. In these excluded load cases ignition voltage levels outside the limits may be permitted without deviating from the scope of the present invention.

What is claimed is:

1. A method for controlling spark ignition of a fuel/air mixture supplied to combustion chambers of an Otto engine of the type including an ignition voltage-generating system which comprises, in each combustion chamber, respective fixed and movable spark plug electrodes respectively attached to such chamber and to a moveable piston in such chamber, the ignition voltage generating system further comprising means to generate spark ignition voltage between each pair of respective fixed and moveable spark plug electrodes, the method comprising, at each of different engine speeds and for each associated pair of fixed and moveable spark plug electrodes the steps of:

detecting the actual engine load; and for a first engine load value, generating spark ignition voltage at a first predetermined ignition timing point corresponding to a specific crankshaft angle before top dead center when the respective electrodes are separated by a first predetermined distance;

for a second engine load value greater than the first value, generating spark ignition voltage at a second predetermined ignition timing point corresponding to another specific crankshaft angle before top dead center when the respective electrodes are separated by a second predetermined distance shorter than the first distance; and generating spark ignition voltage according to the foregoing steps over essentially the whole load range of the engine;

whereby the spark ignition voltage is maintained within a lower and an upper limit selected to promote adequate ignition of the fuel/air mixture.

2. The method according to claim 1, wherein the respective steps of generating spark ignition voltage comprise varying such voltage by less than 20 percent about the mean value of the lower and upper limits.

3. The method according to claim 1, wherein the engine has a ratio between a connecting rod length and a crankshaft radius which is within the values 3.3 and 3.8.

4. The method according to claim 1, wherein the respective steps of generating spark ignition voltage comprise varying such voltage within the limits of 20 kV and 30 kV.

5. The method according to claim 4, wherein the ignition voltage generating system is of the capacitive type and the engine has a ratio between a connecting rod length and a crankshaft radius of between 3.4 and 3.5.

6. The method according to claim 1, wherein the separation of the respective electrodes when the sparking ignition voltage is generated is less than 5.5 mm at 25 crankshaft angle degrees before the top dead center of the piston.

7. The method according to claim 1, wherein the movable spark plug electrode is an earth electrode.

8. A system for controlling spark ignition of a fuel/air mixture supplied to combustion chambers of an Otto engine of the type including an ignition voltage-generating system which comprises, in each combustion chamber, respective fixed and movable spark plug electrodes respectively attached to such chamber and to a moveable piston in such chamber, the ignition voltage generating system further comprising means to generate spark ignition voltage between each pair of respective fixed and moveable spark plug electrodes, the system comprising, at each of different engine speeds and for each associated pair of fixed and moveable spark plug electrodes:

means for detecting the actual engine load; and for a first engine load value, means for generating spark ignition voltage at a first predetermined ignition timing point corresponding to a specific crankshaft angle before top dead center when the respective electrodes are separated by a first predetermined distance;

for a second engine load value greater than the first value, means for generating spark ignition voltage at a second predetermined ignition timing point corresponding to another specific crankshaft angle before top dead center when the respective electrodes are separated by a second predetermined distance shorter than the first distance; and means for generating spark ignition voltage according to the foregoing means over essentially the whole load range of the engine;

whereby the spark ignition voltage is maintained within a lower and an upper limit selected to promote adequate ignition of the fuel/air mixture.

9. The system according to claim 8, wherein the respective means for generating spark ignition voltage comprise means for varying such voltage by less than 20 percent about the mean value of the lower and upper limits.

10. The system according to claim 8, wherein the engine has a ratio between a connecting rod length and a crankshaft radius which is within the values 3.3 and 3.8.

11. The system according to claim 8, wherein the respective means for generating spark ignition voltage comprise means for varying such voltage within the limits of 20 kV and 30 kV.

12. The system according to claim 11, wherein the ignition voltage generating system is of the capacitive type and the engine has a ratio between a connecting rod length and a crankshaft radius of between 3.4 and 3.5.

13. The system according to claim 8, wherein the separation of the respective electrodes when the sparking ignition voltage is generated is less than 5.5 mm at 25 crankshaft angle degrees before the top dead center of the piston.

14. The system according to claim 8, wherein the movable spark plug electrode is an earth electrode.

* * * * *